United States Patent [19]

Craycraft

[11] 4,051,409

[45] Sept. 27, 1977

[54] LOAD AND HOLD SYSTEM FOR PLASMA CHARGE TRANSFER DEVICES

[75] Inventor: Donald Gregory Craycraft, St. Charles, Ill.

[73] Assignee: NCR Corporation, Dayton, Ohio

[21] Appl. No.: 648,767

[22] Filed: Jan. 13, 1976

[51] Int. Cl.[2] ..... H05B 41/30; H05B 41/44

[52] U.S. Cl. ..... 315/169 TV; 340/168 S; 340/324 M

[58] Field of Search ..... 315/169 TV, 169 R; 340/324 R, 324 M, 168 S, 343

[56] References Cited

U.S. PATENT DOCUMENTS

| | | | |
|---|---|---|---|
| 3,781,600 | 12/1973 | Coleman et al. | 315/169 TV |
| 3,911,422 | 10/1975 | McDowell et al. | 340/324 M |
| 3,925,703 | 12/1975 | Schermerhorn | 315/169 TV |

*Primary Examiner*—Eugene R. LaRoche
*Attorney, Agent, or Firm*—Lowell C. Bergstedt

[57] ABSTRACT

A system for loading a plasma charge transfer device and for holding charges applied thereto. Input and transfer electrodes are positioned on opposing walls which define a channel confining an ionizable medium. The electrodes are arranged for the application of potential differences between adjacent electrodes whereby the charges may be shifted away from the input electrode to a desired location and in a desired pattern along the length of the device. The charges are then held at the desired location by applying potential differences in a fashion such that the charge is circulated between a set of at least four sequentially positioned transfer electrodes at the desired holding location.

13 Claims, 9 Drawing Figures

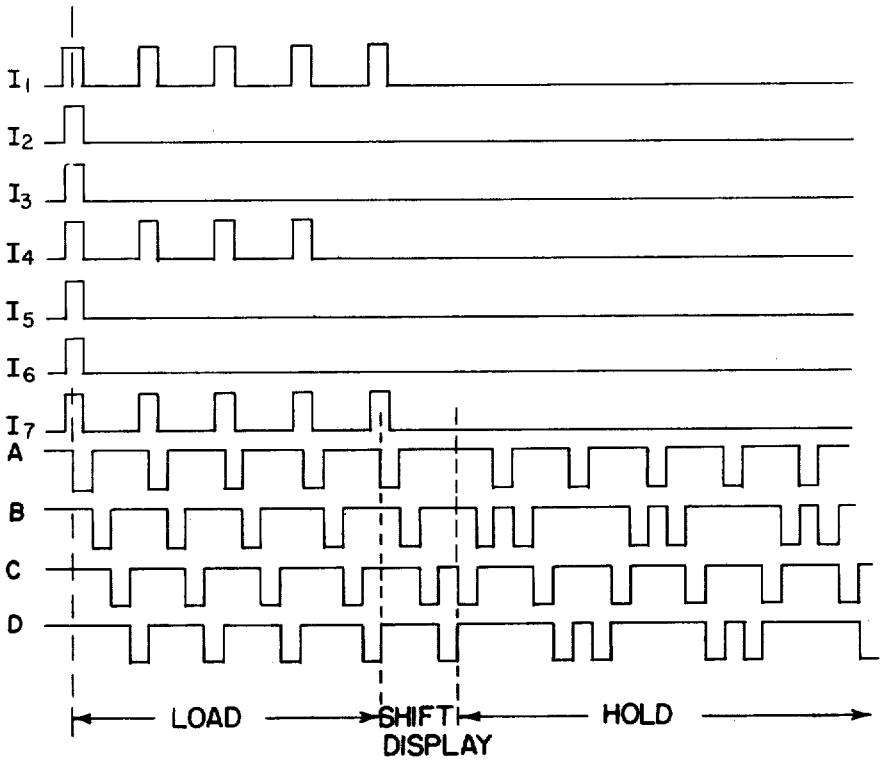
FIG. 3
FIG. 4
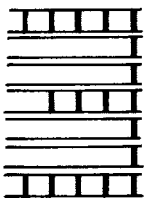
FIG. 5
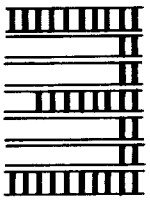

LOAD AND HOLD SYSTEM FOR PLASMA CHARGE TRANSFER DEVICES

BACKGROUND OF THE INVENTION

This invention relates to a plasma charge transfer system and, in particular, to a method and means for operating a plasma charge transfer device.

Devices of the general type referred to are described in Coleman, et al. U.S. Pat. No. 3,781,600, dated Dec. 25, 1973, and entitled "Plasma Charge Transfer Device". Such devices generally comprise a channel containing an ionizable medium, particularly an ionizable gas such as neon and nitrogen. The channel is defined within a walled structure, and for display purposes, at least one wall is formed of a transparent material. An input electrode is provided at one end of the device, and transfer electrodes are located opposite each other in a line extending along the channel. By applying potential differences between the oppositely positioned electrodes, the gas is ionized, and light emission occurs. By applying the potential differences in proper sequence, and particularly through the utilization of a plurality of channels, light displays of numbers, letters, or other patterns can be realized. The arrangement permits shifting of the displays along the length of the devices, and holding of the displays in position when so desired.

THE PRESENT INVENTION

In accordance with known practice, displays produced in the manner described may be held in position but, in the event that new information is to be loaded into a device after holding, it has been necessary to reload the device with both the new and the old information. The present invention involves a technique whereby information previously loaded into a device can be retained with the new information being loaded into the device while simply shifting the already loaded information along the device in synchronism with the information being newly loaded.

The means and method for achieving a holding operation followed by additional loading without reloading basically involves the circulation of charges at a holding location in a fashion such that a display or other function can be achieved and subsequently shifted. The technique involves the use of a basically conventional plasma charge device in conjunction with means for operating the device in the unique fashion of this invention.

A main object of this invention is, thus, the provision of a plasma charge device which is capable of receiving a pattern of charges for shifting along the device, and which is capable of holding the charges for a desired period of time and for thereafter loading additional charges without the need for reloading of any previously introduced charges.

It is a more particular object of the invention to provide a device operating in the fashion described which is achieved through the utilization of uncomplicated control systems whereby the objects of the invention are accomplished with maximum efficiency.

Other objects and advantages of the invention will be apparent from a consideration of the following description which includes the following drawings:

FIG. 3 is an illustration of wave forms which are characteristic of the operation of the invention;

FIG. 4 is an illustration of a pattern which is characteristics of prior art displays;

FIG. 5 is an illustration of a pattern which is achieved in accordance with an alternative form of the invention;

SPECIFIC DESCRIPTION OF THE DRAWINGS

The subject matter of this invention generally relates to a system for loading and holding charges in a plasma charge transfer device. The system is particularly characterized by a holding arrangement which permits the subsequent shifting of input data during introduction of new data whereby there is no necessity for the repeating of input information for old data when new data is being introduced.

Figure 1:
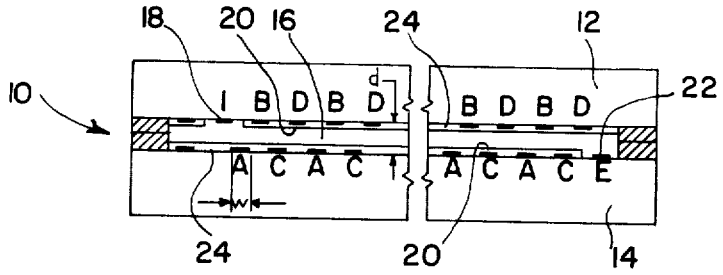
FIG. 1 is a cross-sectional view of a plasma charge transfer device suitable for operation in accordance with the concepts of this invention.

A device 10 of the type involved in the practice of the invention is illustrated in FIG. 1. This structure comprises a rear plate 12 and a front plate 14. In the usual practice of the invention, at least a front plate is formed of a transparent material, for example, any suitable glass whereby ionization will result in a visible display. It will be understood that such ionization occurs even in systems which involve data input without a visible display and, accordingly, the concepts of this invention can be practiced even though a visible system is not involved.

The plates 12 and 14 are held in spaced-apart relationship whereby a channel 16 is defined between the plates. An ionizable medium such as any one of, or a mixture of, the gases neon, argon, helium, kypton, xenon, hydrogen and nitrogen, is sealed within the channel. A plurality of electrodes including input electrode 18, transfer electrodes 20, and erase electrode 22 are disposed on the opposing walls of the channel. At least the electrodes 20 on the plate 14 may be formed of a transparent material such as tin oxide although this is not necessary. A thin insulating coating 24 covers the transfer electrodes 20, and at least the coating on the plate 14 is transparent, for example, a dielectric glass formed of a silk screened glass plate. Since the front and rear electrodes are staggered, visible display "dots" occur even if the front electrodes are opaque.

The structure of FIG. 1 involves the presence of the ionizable medium between the opposed alternating transfer electrodes. Thus, the electrodes comprise interdigitated members, and they are positioned in a regular alternating sequence, indicated by the letters "A", "B", "C" and "D". Reading from left to right from the input electrode 18, the electrodes have a ABCD, ABCD, etcetera, positioning.

For the reasons more particularly set forth in the aforementioned Patent No. 3,781,600, the input electrode 18 may be exposed to the ionizable medium, that is, it is not covered by the insulating material 24. This enables start-up of the device when a sufficient potential difference is developed between the input electrode and the oppositely positioned transfer electrode 20 designated A. The potential difference results in the creation of a positive charge adjacent the transfer electrode as is characteristic of devices of this type. By creating a sufficient potential difference between the next adjacent electrode B and the electrode A having the positive charge, the ionization position will shift. The charge can then be moved progressively along the channel by continuing to apply potential differences between adjacent electrodes.

All of the electrodes 20 with the same letter designation are connected in common so that an A pulse changes the potential of each A transfer electrode, a B pulse changes the potential of each B transfer electrode, etcetera. Accordingly, and as more fully explained in the aforementioned patent, additional charges are introduced by providing an input pulse in conjunction with an A pulse. This enables shifting of several charges simultaneously along the same channel.

Figure 2:
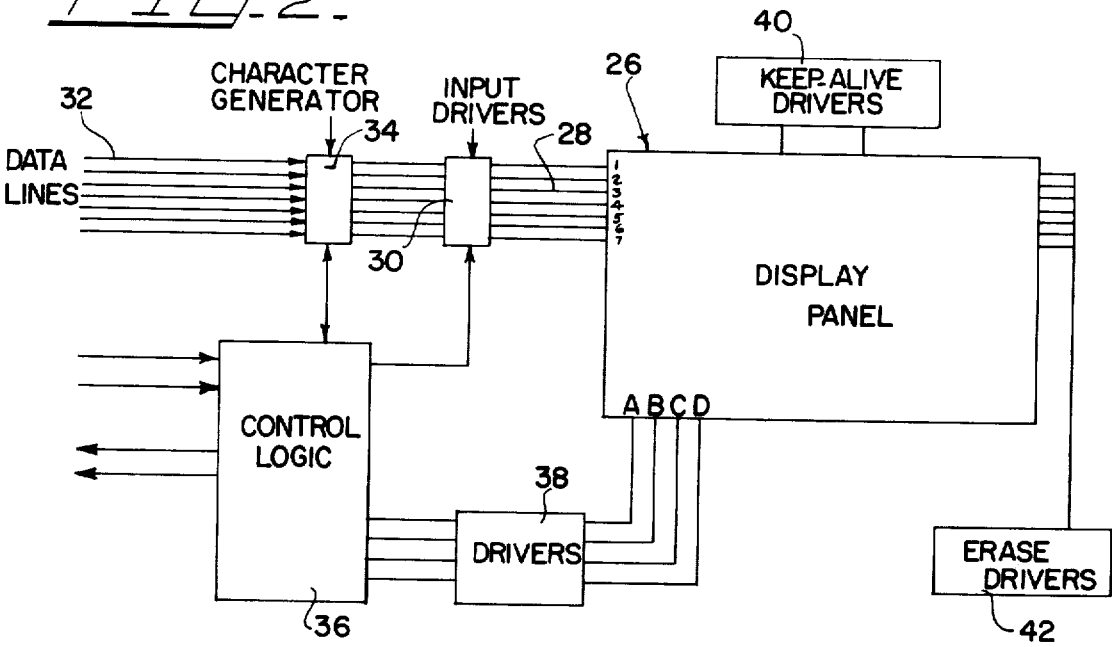
FIG. 2 is an illustration of a control circuit employed in accordance with the techniques of the invention.

The above description applies to a single channel which would result in one or more "pips" of light along the length of the channel as the pulses are applied. In order to provide a display device for letters and numerals, a plurality of such channels are utilized together. FIG. 2 illustrates a display panel 26 with 7 channels being designated, each channel having a line 28 for introducing a pulse to the input electrode 18 of the channel from the input driver 30. The data lines 32 feed character generator 34 for purposes of operating the respective input drivers.

Control logic means 36 are connected to drivers 38 which pulse the respective transfer electrodes. In accordance with conventional practice, several channels share the driver input signals so that pulses are applied simultaneously to each A electrode of each channel, to each B electrode of each channel, etcetera. The schematic arrangement of FIG. 2 also illustrates "keep-alive" drivers 40 and erase drivers 42 which also operate in conventional fashion.

The seven indicated channels of the display panel 26 are used to display numbers or letters in a line extending from left to right. One or more additional lines, each made up of seven channels, may be provided on the display panel.

FIG. 3 illustrates the input and transfer electrode pulses which may be applied to the display panel 26 for purposes of achieving the display of a numeral "3" along the character line of the seven channels shown. The control mechanisms initially operate the input drivers for the channels 1 through 7 whereby the potential of the input electrodes 18 for these channels is increased from ground to a positive potential. The driver for the A transfer electrodes then operates to drive the potential for these transfer electrodes from a positive state to ground whereby the potential difference results in a charge opposite the first A transfer electrode of each channel. As shown in FIG. 3, the B, C and D transfer electrodes are then pulsed in sequence to move the charge in channels 1 through 7 to a position opposite the first D transfer electrodes of each channel.

At this point, additional input signals are applied to channels 1, 4 and 7, and then to the A transfer electrodes. This results in the development of new charges opposite the first A transfer electrode of channels 1, 4 and 7. In addition, the potential difference developed between the first D transfer electrode and the second A transfer electrode shifts the initially introduced charges in all 7 channels to a position opposite the second A transfer electrodes of these channels. When the B, C and D transfer electrodes are then pulsed as illustrated, charges are shifted to positions opposite the first D transfer electrodes (channels 1, 4 and 7) and opposite the second D transfer electrodes (all channels).

As shown in FIG. 3, third input pulses are then applied to channels 1, 4 and 7 followed by ABCD pulsing. Fourth input pulses are applied to channels 1, 4 and 7 again followed by ABCD pulsing. The final step in producing the numeral 3 involves the pulsing of the input electrodes for channels 1 and 7 followed by ABCD pulsing. This operation, of course, continues to shift the initial charges as well as introducing new charges.

The position of the numeral 3 can be moved along the channels by continuing ABCD pulsing. As long as there are no input signals applied, this numeral will appear alone on the display. Naturally, displays of two or more numeral and letter combinations, or other symbols can be readily introduced.

Figure 6:
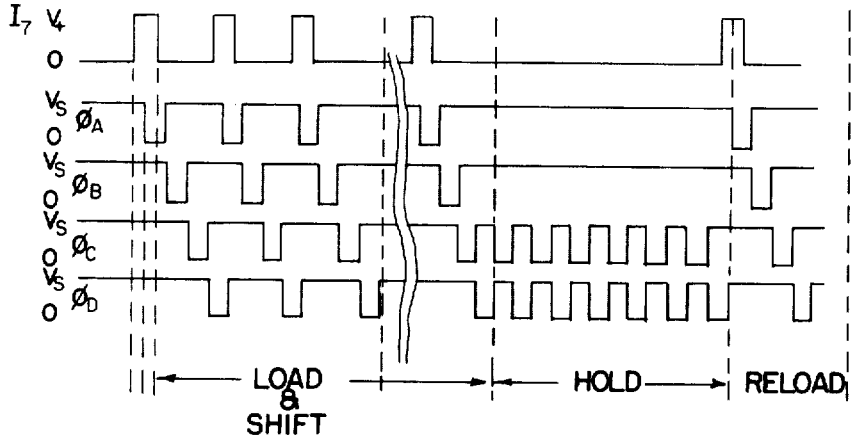
FIG. 6 is an illustration of wave forms which are characteristic of prior art operations.

FIG. 6 illustrates channel 7 and the pulsing sequence for this channel shown in FIG. 3. The charges introduced have been shifted to a desired location along the channel, and the pulsing illustrated beyond the load and shift operation demonstrates the manner in which the charges in this channel are held in this position. Thus, the charges in the channel are located opposite D transfer electrodes after movement to the desired location along the channel and by holding these charges in this location, a substantially stationary display is provided.

The holding illustrated in FIG. 6 is accomplished by applying a pulse to the C transfer electrodes which, as best shown in FIG. 1, will shift the charges from right to left to positions opposite the C transfer electrodes. A D pulse is then applied followed by a C pulse, and so on whereby the charge is moved back and forth between the C and D transfer electrodes. To the observer, the "pips" of light are substantially stationary, and when this holding pulse is applied to all channels simultaneously, the entire numeral 3 will appear as a substantially stationary figure. The same will, of course, be true in terms of more complex displays.

FIG. 4 illustrates the appearance achieved during a hold of the type accomplished with the CD pulsing of FIG. 6. In this illustration, it is assumed that the C transfer electrode is opaque in which event a single "pip" will occur opposite each D electrode involved in the hold operation. Considering each ABCD set of transfer electrodes as a display cell, the size of the display will be one fourth the display cell area.

It has been found that the method of holding described has caused the gradual build-up of some additional charge on the neighboring transfer electrodes in each display cell. Accordingly, when a hold of even a relatively short duration was concluded, it became impossible to shift the charges; that is to advance characters already loaded into the display one or more positions in either direction. For example, at the conclusion of a CD holding sequence, the mere application of a pulse to the A transfer electrodes would not result in proper shifting of the charge from the D electrodes to the adjacent A electrodes.

As a result, prior systems have followed the sequence shown in FIG. 6 subsequent to the holding operation. Specifically, a new input pulse is applied for purposes of re-loading the information initially loaded. Thus, if it were desired that the numeral 3 be returned to the position on the channel and then shifted along the channel, it was necessary to completely repeat the sequence shown in FIG. 6.

As indicated, this invention is particularly concerned with an improved holding technique which eliminates the necessity for loading in the manner described. Referring again to FIG. 3, pulsing suitable for holding the display of the numeral 3 in accordance with the concepts of this invention is illustrated. In this connection, it will be noted that after the display has been shifted to the desired position, charges are located opposite those D electrodes as described. The holding sequence first involves C pulsing which shifts the charges back to adjacent C electrodes. Subsequent B and A pulses result in further shifting from right to left. As indicated, the following pulsing is in the sequence BCD, and then the charge is continuously circulated by a ADCBABCD pulsing sequence.

The hold mode described and shown in FIG. 3 results in a display as shown in FIG. 5. Again referring to FIG. 1, it will be noted that the ADCBABCD sequence results in a light display opposite the B and D electrodes twice in each pulsing sequence. This "double dot" display is, of course, visible, and represents a display over an area twice the area of the single dot display of FIG. 4. Even though the intensity of the light display is necessarily reduced since the frequency of discharge is reduced, a highly effective visual display is achieved. Thus, the intensity of the display is fully sufficient, and in view of the larger display area, the display is easily readable. Furthermore, the frequency is sufficient to maintain the illusion of a continuous display and is, therefore, completely satisfactory to the viewer.

More importantly, the hold mode which in this instance involves 5 transfer electrodes, eliminates the build-up of additional charges which characterizes the CD hold mode. It has been found that the application of shifting pulses beyond the transfer electrodes involved in the holding operation, results in the shifting of already existing display. Accordingly, the material displayed on a panel can be held for a desired duration, and then shifted along the panel while at the same time new information is being applied to load at the input end of the channel.

Figure 7:
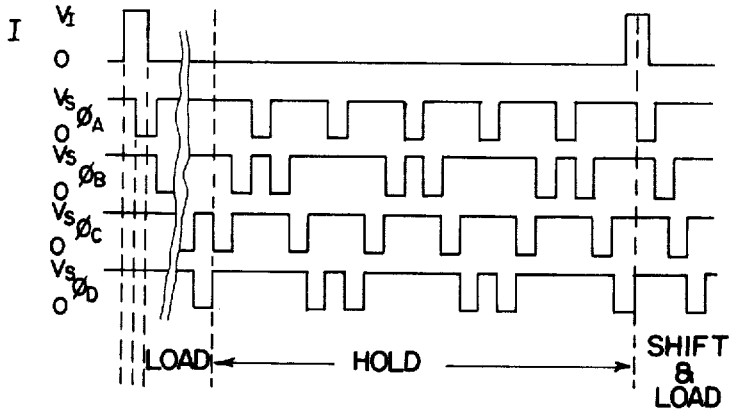
FIG. 7 is an illustration of a wave form characteristic of the operation of this invention.

FIG. 7 illustrates the loading of a charge into a channel followed by repeated ABCD pulsing whereby the charge is located opposite a D electrode along the length of the channel. The subsequent CBABCDADCBA, etcetera, pulsing will shift this charge between the set of five electrodes and achieve the "double-dot" display described. When the holding sequence has been completed, the charge will be present opposite the same D electrode, and the subsequent ABCD pulsing illustrated will then shift the charge along the display. When an input signal is provided either at this time or at some other point in the sequence, a new charge can be introduced at the input end of the channel. Accordingly, simultaneous shifting and loading is achieved with the arrangement of this invention.

Figure 8:
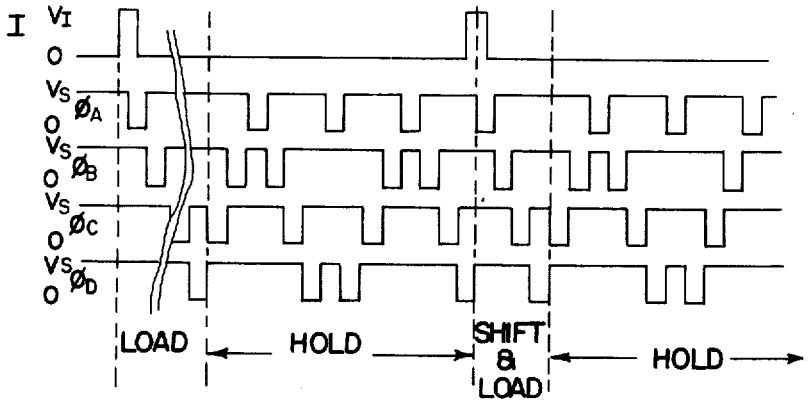
FIG. 8 is an illustration of other wave forms characteristic of the operation of this invention; and, FIG. 9 is an illustration of additional wave forms characteristic of the operation of the invention.

FIG. 8 illustrates a sequence corresponding to that shown in FIG. 7 wherein the charge initially introduced into a channel is held using the ABCDADCB hold mode. The charge is then shifted as described with reference to FIG. 7 by the application of ABCD pulsing, and there is a simultaneous charge introduced by the application of an input pulse.

A subsequent holding operation is then applied as shown in FIG. 8 by the application of the same hold mode. It will be appreciated that this hold applies to the originally introduced charge as well as to the newly introduced charge. It will thus be seen that displays can be regularly introduced, shifted, held, shifted again during loading of new displays, and then held again along with the new displays. In this connection, it will be appreciated that the shifting can be carried out in either direction using the techniques described.

Figure 9:
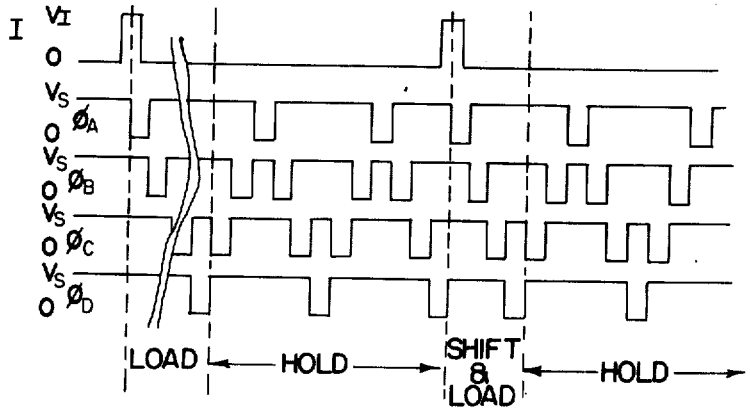

FIG. 9 illustrates an arrangement of the invention wherein the hold is achieved utilizing four transfer electrodes, particularly the transfer electrodes in the display cell to which a charge has been shifted. In considering this figure, it will be noted that as in the case of FIG. 8, a charge is applied and moved to a D electrode along the length of the channel. In order to hold the charge in position, pulses are applied to a CBABCD sequence. Referring to FIG. 1, it will be appreciated that this moves the charge within one display cell; however, if the C and A electrodes are opaque, a single dot will appear opposite the B electrode and a single dot will appear opposite the D electrode. Ionization will, however, occur twice in each sequence opposite the B electrode, while the ionization opposite the D electrode will occur only once in each sequence. The light display at the D position will then be one-half as bright as the brightness opposite the B electrode.

Circulating the charge between the four transfer electrodes in a single cell during the hold operation does, however, result in an elimination of the charge build-up which characterizes the conventional CD hold. Accordingly, the hold mode of FIG. 9 does achieve a system which permits shifting of an already present charge along with loading of a new charge after a hold operation has taken place for a given duration.

It will be understood that various changes and modifications may be made in the above described construction which provide the characteristics of the invention without departing from the spirit thereof particularly as defined in the following claims.

That which is claimed is:

1. In a plasma charge transfer device of the type having a channel containing an ionizable medium, said channel being defined within a walled structure, input and transfer electrodes positioned on the inside wall surfaces, said transfer electrodes being arranged in alternating sequence and opposite from one another on opposite inside wall surfaces, and means for applying a potential difference between adjacent electrodes whereby the medium will emit light proximate said adjacent electrodes and leave a charge proximate one of said adjacent electrodes, the application of succeeding potential differences between adjacent transfer electrodes along the length of the device operating to shift said charge away from the position of the input electrode, the improvement comprising means for holding a charge in that location of the device to which the charge has been shifted, said holding means including means for circulating the charge between the electrodes of a set of at least four sequentially positioned transfer electrodes.

2. A device in accordance with claim 1 including means for resuming shifting of said charge after said holding, comprising means for applying successive potential differences to transfer electrodes in a direction away from said input electrode and away from said set of transfer electrodes.

3. A device in accordance with claim 1 wherein said set includes that the transfer electrode immediately beyond the last transfer electrode to which said charge is shifted, said set also including said last transfer electrode and at least the two preceding transfer electrodes.

4. A device in accordance with claim 3 wherein at least one of said walls is transparent, visible light being emitted at the position of at least one transfer electrode in said set during said circulating.

5. A device in accordance with claim 3 wherein said set includes three of said preceding transfer electrodes.

6. A device in accordance with claim 5 wherein at least one of said walls is transparent, visible light being emitted through said transparent wall at the position of two of the electrodes of said set during said circulating.

7. A method for operating a plasma charge transfer device of the type having a channel containing an ionizable medium, said channel being defined within a walled structure, input and transfer electrodes positioned on the inside wall surfaces, said transfer electrodes being arranged in alternating sequence and opposite from one another on opposite inside wall surfaces, the application of a potential difference between adjacent electrodes causing the medium to emit light proximate said adjacent electrodes and leave a charge proximate one of said adjacent electrodes, the application of succeeding potential differences between adjacent transfer electrodes along the length of the device operating to shift said charge away from the position of the input electrode, the improved method for holding a charge in that location of the device to which the charge has been shifted, said method comprising circulating the charge between the electrodes of a set of at least four sequentially positioned transfer electrodes, the transfer electrodes of said set being positioned at said location.

8. A method in accordance with claim 7 including the step of resuming shifting of said charge after said holding by applying successive potential differences to transfer electrodes in a direction away from said input electrode and away from said set of transfer electrodes.

9. A method in accordance with claim 7 including the step of resuming shifting of said charge after said holding by applying successive potential differences to transfer electrodes in a direction toward said input electrode and away from said set of transfer electrodes.

10. A method in accordance with claim 7 wherein said set includes that the transfer electrode immediately beyond the last transfer electrode to which said charge is shifted, said set also including said last transfer electrode and at least the two preceding transfer electrodes.

11. A method in accordance with claim 10 wherein at least one of said walls is transparent, said circulating resulting in the emission of visible light at the position of at least one transfer electrode in said set.

12. A method in accordance with claim 10 wherein said set includes three of said preceding transfer electrodes.

13. A method in accordance with claim 12 wherein at least one of said walls is transparent, said circulating resulting in the emission of visible light at the position of two of the electrodes of said set.

* * * * *